US005813338A

United States Patent [19]

Kojima et al.

[11] Patent Number: 5,813,338

[45] Date of Patent: Sep. 29, 1998

[54] GRIPPER OPENING/CLOSING MECHANISM OF SHEET TRANSFER CYLINDER IN SHEET-FED PRINTING MACHINE

[75] Inventors: Yasutaka Kojima, Yawara; Masaaki Sugamo, Mitsukaido, both of Japan

[73] Assignee: Akiyama Printer Manufacturing Co., Ltd., Tokyo, Japan

[21] Appl. No.: 916,261

[22] Filed: Aug. 22, 1997

[30] Foreign Application Priority Data

Oct. 31, 1996 [JP] Japan ..... 8-289433

[51] Int. Cl.[6] ..... B41F 7/06

[52] U.S. Cl. ..... 101/231; 101/409; 271/277

[58] Field of Search ..... 101/409, 410, 101/229, 231, 232, 411; 271/277

[56] References Cited

U.S. PATENT DOCUMENTS

| | | | |
|---|---|---|---|
| 1,815,895 | 7/1931 | Bennison | 101/410 |
| 2,175,665 | 10/1939 | Kluitmann | 101/409 |
| 3,151,552 | 10/1964 | Peyrebrune | 101/409 |
| 4,390,176 | 6/1983 | Kato | 101/411 |
| 4,759,290 | 7/1988 | Höll et al. | 101/409 |
| 4,900,008 | 2/1990 | Fichter et al. | 101/409 |
| 4,905,985 | 3/1990 | Nagatani | 101/409 |
| 4,928,586 | 5/1990 | Kida | 101/411 |
| 5,186,107 | 2/1993 | Wieland | 101/409 |
| 5,555,804 | 9/1996 | Kojima | 101/231 |
| 5,678,486 | 10/1997 | Bachmeir et al. | 101/409 |

*Primary Examiner*—Eugene H. Eickholt
*Attorney, Agent, or Firm*—Wenderoth, Lind & Ponack, L.L.P.

[57] ABSTRACT

In order to improve a gripper opening/closing mechanism of a sheet transfer cylinder in a sheet-fed printing machine in the prior art, the gripper opening/closing mechanism of the sheet transfer cylinder in the sheet-fed printing machine comprises: a plurality of grippers; a gripper shaft whereupon the plurality of grippers are disposed over specific intervals; and a cam mechanism provided at each of two ends of the gripper shaft, which cause the gripper shaft to move when the sheet transfer cylinder has rotated to a first specific position so that the grippers and the external circumferential side surface of the sheet transfer cylinder come in contact with each other and causes the gripper shaft to move in the opposite direction when the sheet transfer cylinder has rotated to a second specific position so that the grippers and the external circumferential side surface of the sheet transfer cylinder depart from each other. With the sheet transfer cylinder of the sheet-fed printing machine thus structured to constitute the pick-up cylinder, the impression cylinders, the intermediate cylinders and the delivery cylinders, torsion in the gripper shaft during opening/closing of the grippers is prevented and the opening/closing of the grippers can be performed in a consistent manner.

11 Claims, 5 Drawing Sheets

GRIPPER OPENING/CLOSING MECHANISM OF SHEET TRANSFER CYLINDER IN SHEET-FED PRINTING MACHINE

BACKGROUND OF THE INVENTION

1. Field of the Invention

The present invention relates to a sheet transfer mechanism of a sheet-fed printing machine and, more specifically, to a gripper opening/closing mechanism of a sheet transfer cylinder in a sheet-fed printing machine that is constituted of an arrangement of the following cylinders, i.e., a pick-up cylinder, impression cylinders, intermediate cylinders and delivery cylinders.

2. Description of the Related Art

A gripper opening/closing device in a sheet transfer cylinder normally employed in the prior art often adopts a plate cam system, and furthermore, the force that opens/closes the gripper is applied only at one side of the sheet transfer cylinder. In this plate cam system in the prior art, a spring is used to prevent the roller and lever assembly from jumping. As a result, if the spring pressure is great, wear of the cam and the roller is hastened and, at the same time, the motive power consumption also increases. Therefore, if the rotating speed is increased, it becomes practically impossible to prevent the roller and lever assembly from jumping. This problem constitutes a cause for defective printing registration since it affects paper handling adversely. In addition, it prevents achievement of a faster printing mechanism.

The mechanism in the prior art is explained in further detail in reference to FIGS. 3A through 5. In FIGS. 3A–B, which shows a cylinder gripper opening/closing mechanism employing a plate cam system in the prior art, reference number 11 indicates a gripper shaft, reference number 12 indicates gripper shaft intermediate metal portion, reference number 13 indicates a gripper, reference number 14 indicates a lever, reference number 15 indicates a cam, reference number 16 indicates a cam mounting flange, reference number 17 indicates a cylinder shaft receptacle metal portion, reference number 18 indicates a frame, reference number 20 indicates a spring, reference number 21 indicates a spring guide rod and reference number 22 indicates a spring receptacle. It is to be noted that S indicates a sheet transfer cylinder that constitutes a pick-up cylinder, an impression cylinder, an intermediate cylinder and a delivery cylinder. This plate cam system comprises a driver cam P and a follower lever W, as shown in FIG. 4. Since the follower in this structure is normally a reciprocally moving body, if the contact point comes in contact with the cam at only one location, a forceful constraint is required, which may be imparted by a spring, weights or the like. In addition, while a plate cam, an end cam and the like are most often used with this since their outlines can be machined relatively easily, the force of constraint increases the pressure with which the contact point and the cam surface come in contact with each other, increasing wear of the cam outline and fluctuation of the torque. In contrast, if the contact point is in contact with the cam at two locations at the sides, or if two contact points are provided so as to come in contact with the cam from opposite directions, a positive return is imparted to the follower lever. In addition, although the machining will be complicated without using a copy machining device or a generating device since the movement in the lever determined by one contact point must be inversely emulated by the other, a positive motion cam is normally employed to constitute a grooved cam or a multiple cam in the case of a cam with a large displacement.

Moreover, the plate cam system presents the following problems. One problem is that when the rotation speed increases, the follower lever jumps, causing the roller contact to depart from the cam. When this roller comes in contact with the cam again, impact occurs, wearing out the cam surface. This jumping phenomenon is caused by the inertia of the load, which works in the direction that carries the follower lever away from the cam in the negative portion of the acceleration, exceeding the force of the spring constraining the follower lever and the frictional force. As a result, the constraining spring will have to be reinforced in order to ensure that such jumping does not occur. This, in turn, will further increase the torque on the cam shaft, resulting in the spring force and the inertia canceling each other out in the negative portion of the acceleration, and the spring force and the inertia being added to each other in the positive portion so that the cam will have to pull the spring in order to move the follower. Thus, the second problem of the plate cam is increased torque.

In contrast, the conjugate cam system is constituted with two rollers R1 and R2 spanning two cams K1 and K2 as shown in FIG. 5, in a relationship such that, when one of the cams, i.e., the cam K1 is pressing the roller R1, the other cam K2 is being pressed from the opposite direction by the roller R2. Since, with this type of cam, as long as its elements are machined with a high degree of precision, a pre-load can be applied by reducing the distance between the two shafts and the gap between the rollers and the roller shaft can be reduced to zero. In addition, while, in the case of a grooved cam, there is a gap, although it is very small, present between the roller and the groove, constituting the bearing gap of the roller itself, and this gap can be completely eliminated in a conjugate cam.

Furthermore, in the conjugate cam system, by placing the cam shaft center O closer to the V shaped follower lever T, a pre-load can be applied to eliminate backlash. This makes it possible to achieve complete constraint even at high speed.

It is to be noted that FIG. 6 shows a typical cylinder arrangement in an offset printing machine which is known in the prior art. In the figure, reference number 31 indicates an impression cylinder, reference number 32 indicates an intermediate cylinder, reference number 33 indicates a delivery cylinder, reference number 34 indicates a pick-up cylinder and reference number 35 indicates a swing device. In addition, A indicates a paper feed unit, B indicates a printing unit and C indicates a paper output unit.

In this prior art sheet-fed offset printing machine (double-side printing) in the sheets of paper that are stacked in a feeder main body 36 are fed to the printing unit B via a feeder board 37, the swing device 35 and the pick-up cylinder 34 so that printing with four colors is performed on both sides of the sheets. The printing unit B is constituted of four front side printers 40, 42, 44 and 46 and four back side printers 41, 43, 45 and 47. In addition, in this double-side four color process sheet-fed offset printing machine, the front side printers 40, 42, 44 and 46 and the back side printers 41, 43, 45 and 47, which have been formed separately from each other, may be connected alternately, i.e. the first color back side printer 41 is connected next to the first color front side printer 40, then the second color front side printer 42 is connected and so forth. In this configuration, the impression cylinder 31 and the intermediate cylinder 32 constituting each printer for the front and back sides are linked in the horizontal direction, with their individual axes aligned almost linearly. However, it is to be noted that the impression cylinders 31 and the intermediate cylinders 32 may also be arranged so that the line connecting their axes forms a zigzag pattern. With the structure described above, a sheet of paper is transferred from the pick-up cylinder 34 to the impression cylinder 31 of the first front side printer 40 so that printing of the first color is performed on its front side, and then it is transferred to the impression cylinder 31 of the first back side printer 41 so that printing of the first color is performed on its back side. Then, in a manner identical to that described above, printing of the second, third and fourth colors is performed on both the front and back sides of the sheet by the second through fourth front side printers 42, 44 and 46 and by the second through fourth back side printers 43, 45 and 47 alternately. It is to be noted that after the printing is completed, the sheet is ejected onto a paper output tray 39 by a chain gripper 38 via the final impression cylinder 31 through the delivery cylinders 33.

In the prior art method constituted as described above, the following problems arise.

Since the cam is provided only on one side, torsion is induced in the gripper shaft during opening/closing of the gripper, causing the open/close timing of the gripper to differ on the cam side and the opposite side.

Since the plate cam system is employed for the cam, a spring is utilized in order to prevent the lever (with roller) from jumping.

If this spring is made too strong, wear of the cam and the roller is hastened and motive power consumption also increases.

If the rotation rate is raised to deal with the problem mentioned above, it becomes impossible to prevent jumping of the lever (with roller).

As a result, the paper handling is affected adversely causing defective printing registration. In addition, these problems constitute an obstacle to achieving a faster printing machine.

SUMMARY OF THE INVENTION

An object of the present invention is to solve the problems mentioned above by improving the gripper opening/closing mechanism of a sheet transfer cylinder employed in the prior art system as described above.

Accordingly, the gripper opening/closing mechanism of a sheet transfer cylinder in a sheet-fed printing machine according to the present invention is provided with: a plurality of grippers; a gripper shaft upon which the plurality of grippers are provided over specific intervals; and a cam mechanism provided at the two ends of the gripper shaft, which causes the gripper shaft to move when the sheet transfer cylinder rotates to a first specific position, to place the grippers and the external circumferential side surface of the sheet transfer cylinder in contact with each other and causes the gripper shaft to move in the opposite direction when the sheet transfer cylinder has rotated to a second specific position, to cause the grippers to separate from the external circumferential side surface of the sheet transfer cylinder.

In addition, in the gripper opening/closing mechanism of the sheet transfer cylinder in this sheet-fed printing machine, the cam mechanism includes: a lever provided at each end of the gripper shaft perpendicular to the gripper shaft; a first roller and a second roller respectively provided at the outer end of each lever; a first cam that is secured to a frame that holds the rotating shaft of the sheet transfer cylinder and comes in contact with the first roller, having a first surface with a first radius between the first specific position and the second specific position and a second surface with a second radius that is smaller than the first radius; and a second cam secured to the frame that holds the rotating shaft of the sheet transfer cylinder, which comes in contact with the second roller having a second surface with a second radius at a position that corresponds to the first surface of the first cam and a first surface with a first radius at a position that corresponds to the second surface of the first cam.

Moreover, the sheet-fed printing machine is constituted of a paper feed unit, a printing unit and a paper output unit. The sheet transfer cylinder constitutes the pick-up cylinder that transfers sheets of paper from the paper feed unit to the printing unit, the intermediate cylinders provided between printers in a plurality of printers constituting the printing unit, the impression cylinders provided within each of the printers and the delivery cylinders that deliver sheets of paper from the printing unit to the paper output unit, with the gripper opening/closing mechanism provided in each of the sheet transfer cylinders in the entire sheet transfer assembly.

Thus, with the cams provided at the two side portions of the sheet transfer cylinder in the sheet-fed printing machine, the torsion that would otherwise occur in the gripper shaft when the gripper is opened/closed is prevented. At the same time, the opening/closing of the gripper can be made consistent.

In addition, since a conjugate cam system is adopted in the gripper opening/closing mechanism provided in the sheet transfer cylinder to forcibly constrain the roller and lever assemblies, the levers can be prevented from jumping during high speed rotation.

Moreover, the gripper opening/closing mechanism according to the present invention may be provided in a single-cylinder, double-cylinder, triple-cylinder or multiple cylinder configuration and the same advantages are achieved regardless of which type of cylinder configuration it is mounted to. Furthermore, in the embodiment of the present invention, the conjugate cam system may be adopted in a single-side printing or double-side printing sheet-fed printing machine such as an offset printing machine.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate the preferred embodiment. In the drawings.

DETAILED DESCRIPTION OF THE PREFERRED EMBODIMENT

The following is an explanation of an embodiment according to the present invention in reference to the drawings.

Figure 6:
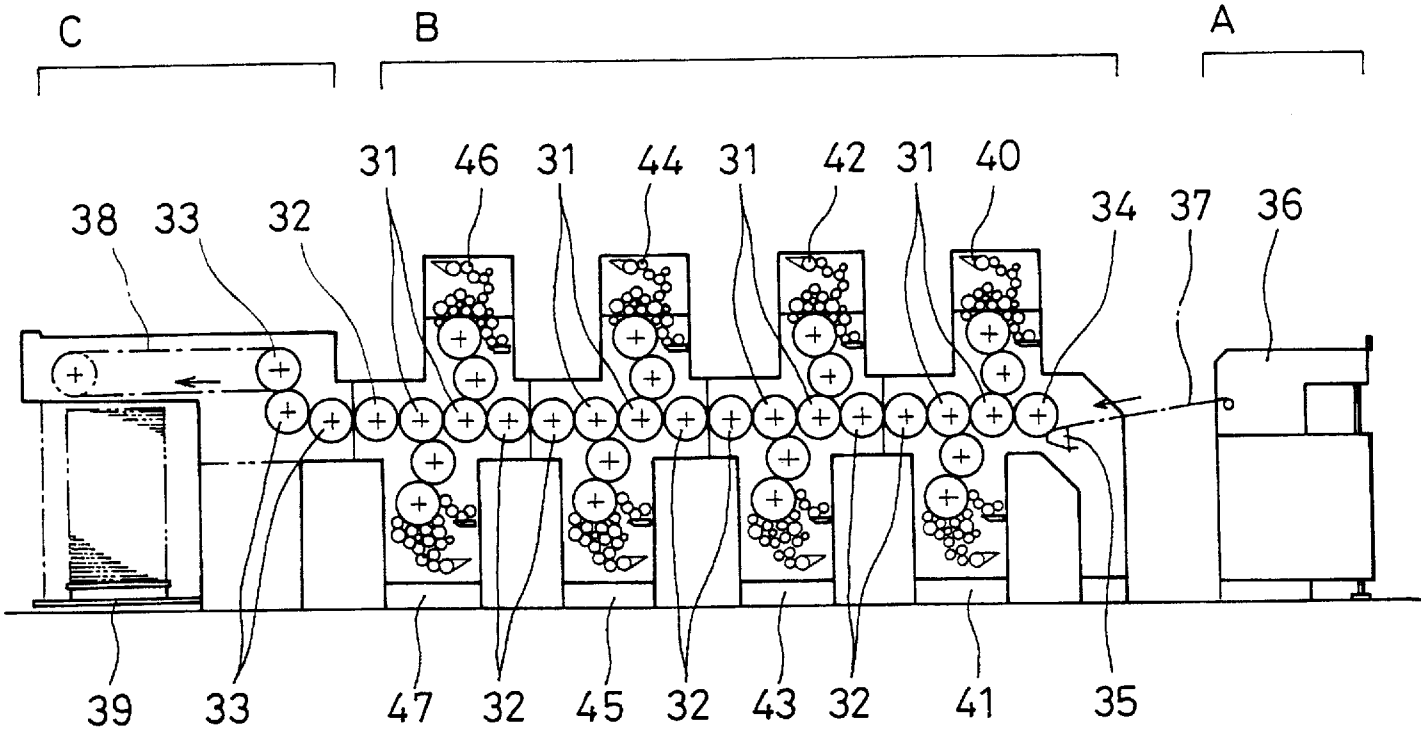
FIG. 6 is a schematic drawing illustrating a cylinder arrangement in a sheet-fed printing machine which is known in the prior art.

The sheet-fed printing machine according to the present invention may be, for instance, the offset printing machine shown in FIG. 6.

This offset printing machine comprises a paper feed unit A, a printing unit B and a paper output unit C.

The paper feed unit A comprises a feeder main body 36 where sheets of paper are stacked, a feeder board 37 where the sheets of paper drawn out from the feeder main body 36, travel to the printing unit and a swing device 35 that transfers the sheets of paper from the feeder board 37 to the pick-up cylinder 34.

The sheets of paper fed from the paper feed unit A to the printing unit B are printed in four colors on both the front and back sides. This printing unit B is comprises four front side printers 40, 42, 44 and 46 and four back side printers 41, 43, 45 and 47. In addition, in this double-side, four color process, sheet-fed offset printing machine, the front side printers 40, 42, 44 and 46 and the back side printers 41, 43, 45 and 47, which have been formed separately from each other, may be alternately connected, i.e. the first color back side printer 41 is connected to the first color front side printer 40, then the second color front side printer 42 is connected and so forth. In this configuration, the impression cylinder 31 and the intermediate cylinder 32 constituting each printer for the front and back sides are all linked in the horizontal direction with their axes aligned almost linearly. However, it is to be noted that the impression cylinders 31 and the intermediate cylinders 32 may be linked so that the line connecting their axes forms a zigzag pattern. With the structure described above, a sheet is transferred from the pick-up cylinder 34 to the impression cylinder 31 of the first front side printer 40 so that printing of the first color is performed on its front side, and then it is transferred to the impression cylinder 31 of the first back side printer 41 so that printing of the first color is performed on its back side. Then, in a manner identical to that described above, printing of the second, third and fourth colors is performed on both the front and the back sides of the sheet by the second through fourth front side printers 42, 44 and 46 and by the second through fourth back side printers 43, 45 and 47 alternately. It is to be noted that after the printing is completed, the sheet is ejected onto the paper output tray 38 by the chain gripper 39 via the final impression cylinder 31 through the delivery cylinders 33.

Figure 1A:
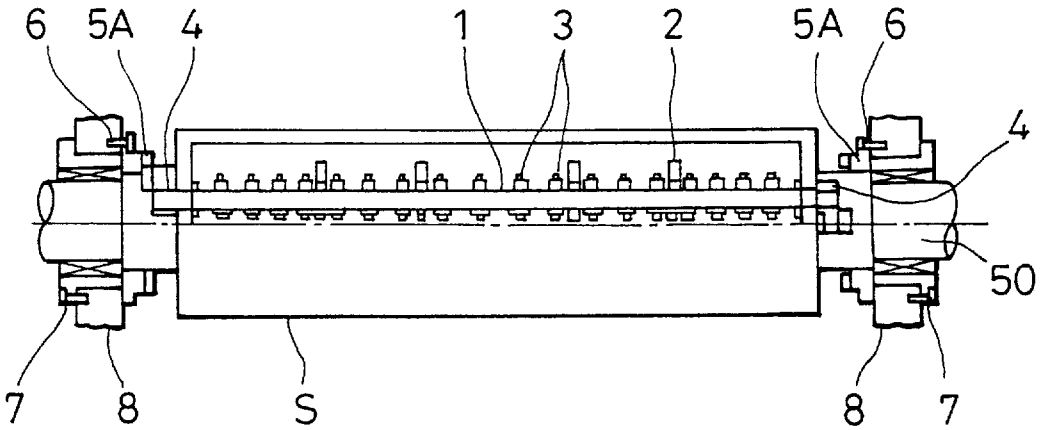
FIG. 1A is a schematic drawing illustrating the gripper opening/closing mechanism of a sheet transfer cylinder employing a conjugate cam system according to the present invention.
Figure 1B:
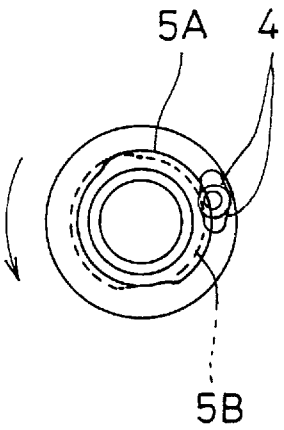
FIG. 1B is an end view of the gripper opening/closing mechanism shown in FIG. 1.
Figure 2:
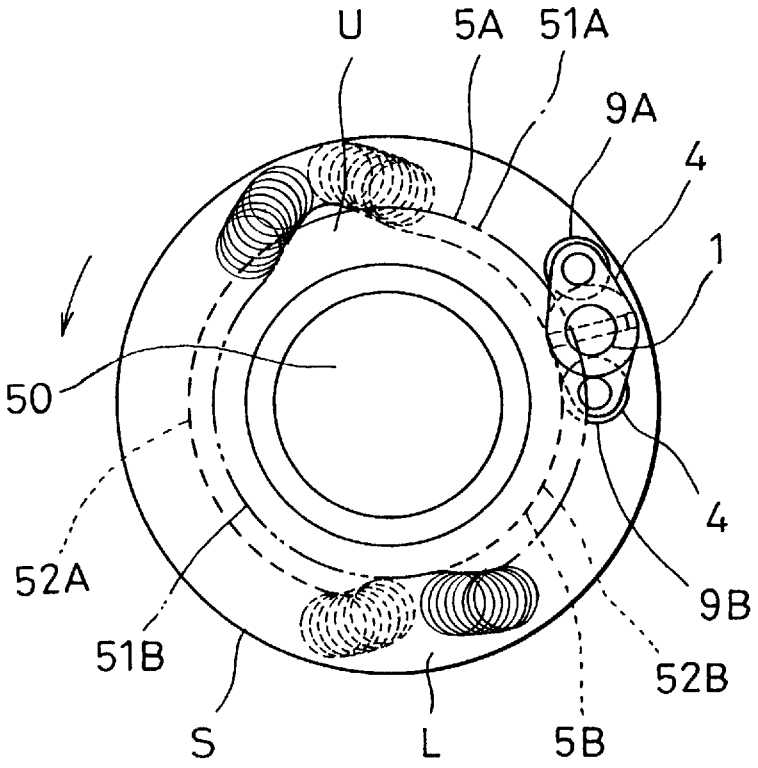
FIG. 2 is a schematic enlargement of an essential portion, of the gripper opening/closing mechanism shown in FIG. 1A.
Figure 3A:
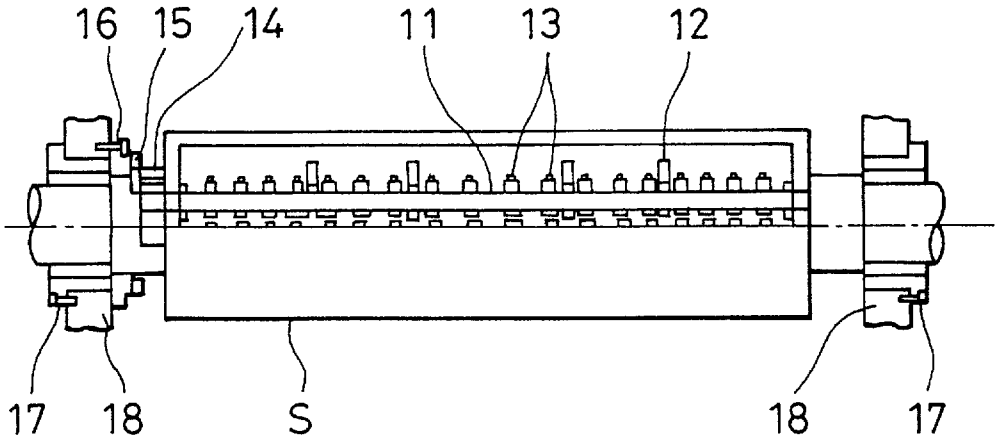
FIG. 3A is a schematic drawing illustrating a gripper opening/closing mechanism employing a plate cam system in the prior art.
Figure 3B:
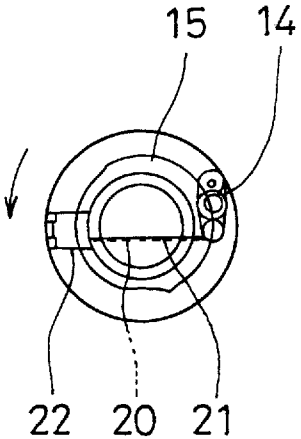
FIG. 3B is an end view of the gripper opening/closing mechanism shown in FIG. 3A.
Figure 4:
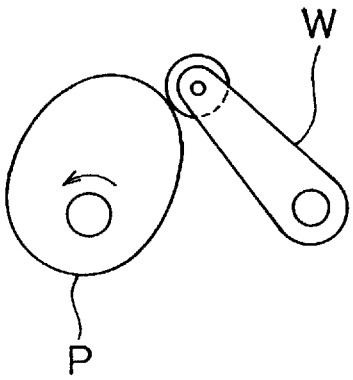
FIG. 4 is a general principle structural drawing illustrating a plate cam which is known in the prior art.
Figure 5:
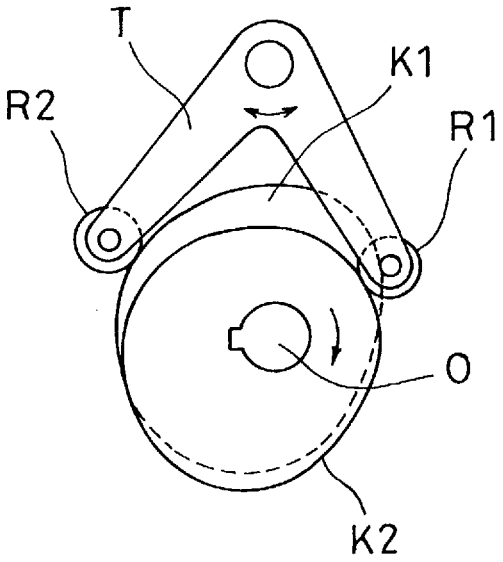
FIG. 5 is a general principle structural drawing illustrating a conjugate cam which is known in the prior art.

FIGS. 1A–B and 2 show the gripper opening/closing mechanism of the sheet transfer cylinder in the sheet-fed printing machine according to the present invention structured as described above. It is to be noted that S in FIG. 1 indicates the sheet transfer cylinder which constitutes the pick-up cylinder and each of the impression cylinders, intermediate cylinders and delivery cylinders.

The gripper opening/closing mechanism provided in this sheet transfer cylinder S grips the end portion of a sheet of paper sent from the preceding process by closing grippers 3 to secure the sheet of paper in the sheet transfer cylinder S and opens the grippers 3 when the sheet of paper has moved to a specific position with the rotation of the sheet transfer cylinder S to transfer the sheet of paper to the next process.

This gripper opening/closing mechanism comprises a plurality of grippers 3, a gripper shaft 1 to which the grippers 3 are mounted, a pair of levers 4 that support the gripper shaft 1 at its two ends movably, rollers 9A and 9B rotatably mounted at the outer ends of each of the levers 4, cams 5A and 5B that come in contact with the rollers 9A and 9B respectively and cam mounting flanges 6 that secure the cams 5A and 5B. In addition, the cams 5A and 5B are secured to a frame 8 that holds a rotating shaft 50 of the sheet transfer cylinder S rotatably via cylinder bearing metal portions 7.

The cam 5A is constituted of a greater circumferential surface 51A with a first radius, which is concentric with the rotating shaft 50 between the first specific position (paper transfer portion) U and a second specific position (paper reception portion) L and a lesser circumferential surface 51B with a second radius smaller than the first radius. In addition, the cam 5B is provided with a lesser circumferential surface 52B with a second radius that is concentric with the rotating shaft 50 at the position corresponding to that of the greater circumferential surface 51A of the cam 5A and a greater circumferential surface 52A with a first radius at a position corresponding to that of the lesser circumferential surface 51B.

By forming the levers 4 and the cams 5A and 5B which come in contact with the rollers 9A and 9B respectively of the levers 4, which constitute the gripper opening/closing mechanism according to the present invention, at the two ends of the gripper shaft 1 where the plurality of grippers 3 are mounted in this manner, torsion in the gripper shaft 1 can be prevented.

In addition, as FIGS. 1 and 2 clearly show, a conjugate cam system is employed in the gripper opening/closing mechanism, comprising the levers 4, the rollers 9A and 9B provided at the two outer ends of the levers 4 and the cam 5A against which the roller 9A travels in contact and the cam 5B against which the roller 9B travels in contact. In other words, a conjugate cam mechanism which is constituted by providing the rollers 9A and 9B at the two sides of the gripper shaft 1 via the levers 4 in addition to the cams 5A and 5*b* is provided.

By providing this conjugate cam mechanism, opening/closing of the gripper can be implemented freely when the sheet transfer cylinder S rotates in the direction indicated with the arrow from the paper transfer portion U to the paper reception portion L. To be more specific, in the paper reception portion L in the lower portion of FIG. 2, the gripper shaft 1 rotates in a specific direction when the roller 9A moves from the lesser circumferential surface to the greater circumferential surface of the cam 5A and the roller 9B moves from the greater circumferential surface to the lesser circumferential surface of the cam 5B so that the grippers 3 grip the sheet of paper sent from the preceding process. When the sheet transfer cylinder S rotates half way through to reach the paper transfer portion U, the roller 9A moves from the greater circumferential surface to the lesser circumferential surface of the cam 5A and the roller 9B moves from the lesser circumferential surface to the greater circumferential surface of the cam 5B causing the gripper shaft 1 to rotate in the direction opposite from that of the previous rotation so that the grippers 3 release the sheet of paper to hand it over to the next process.

With this, in the sheet transfer cylinder of the sheet-fed printing machine constituting the pick-up cylinder and each of the impression cylinders, the intermediate cylinders and the delivery cylinders, a gripper opening/closing mechanism of the sheet transfer cylinder which prevents torsion in the gripper shaft during the opening/closing of the grippers and makes the opening/closing of the grippers consistent is achieved with cams provided at the two sides of the sheet transfer cylinder S. In addition, the gripper opening/closing mechanism of the sheet transfer cylinder employs a conjugate cam system for the cams provided in the sheet transfer cylinder so that the roller and lever assemblies are forcibly constrained by the conjugate cams to prevent the levers from jumping during high speed rotation. The conjugate cam system is provided in the gripper opening/closing mechanism of the sheet transfer cylinder that may constitute a single-cylinder, double-cylinder, triple-cylinder or multiple cylinder configuration.

Furthermore, since the gripper opening/closing mechanism of the sheet transfer cylinder employs the conjugate cam system in a single-side or double-side sheet-fed printing machine such as an offset printing machine, a number of advantages are achieved, as listed below.

By employing the conjugate cam system at the two sides of the sheet transfer cylinder to constitute a gripper opening/closing mechanism;

1. All the problems that are yet to be addressed in the plate cam system in the prior art are eliminated.
2. Torsion in the gripper shaft during opening/closing of the grippers is prevented and the grippers can be opened and closed in a consistent manner.
3. Since the roller and lever assemblies are forcibly constrained, the levers are prevented from jumping even during high speed rotation.
4. Since sheets can be received and transferred smoothly, the accuracy of printing registration is improved. Also, a faster printing machine can be achieved.
5. Similar advantages are achieved with both a double-side printing and single-side printing. Furthermore, similar advantages are achieved in any sheet-fed printing machine regardless of whether offset printing or another printing system is employed.
6. The same advantages are achieved in single-cylinder, double-cylinder and multiple cylinder configurations including triple-cylinder configurations.

What is claimed is:

1. A gripper opening/closing mechanism of a sheet transfer cylinder in a sheet-fed printing machine, comprising:

a plurality of grippers;

a gripper shaft whereupon said plurality of grippers are disposed over specific intervals; and a cam mechanism provided at two ends of said gripper shaft that causes said gripper shaft to move when said sheet transfer cylinder has rotated to a first specific position so that said grippers and an external circumferential side surface of said sheet transfer cylinder come in contact with each other and causes said gripper shaft to move in an opposite direction when said sheet transfer cylinder has rotated to a second specific position so that said grippers and said external circumferential side surface of said sheet transfer cylinder are separated from each other.

2. A gripper opening/closing mechanism of a sheet transfer cylinder in a sheet-fed printing machine according to claim 1, wherein:

said cam mechanism comprises:

a lever mounted at each of two ends of said gripper shaft perpendicular thereto;

a first roller and a second roller respectively provided at outer ends of each said lever;

a first cam that is secured to a frame holding a rotating shaft of said sheet transfer cylinder and in contact with said first roller, which is provided with a greater circumferential surface with a first radius between said first specific position and said second specific position and a lesser circumferential surface with a second radius smaller than said first radius; and a second cam that is secured to said frame holding said rotating shaft of said sheet transfer cylinder and in contact with said second roller, which is provided with a lesser circumferential surface with a second radius at a position corresponding to said greater circumferential surface of said first cam and a greater circumferential surface with a first radius at a position corresponding to said lesser circumferential surface of said first cam.

3. A sheet-fed printing machine disclosed in claim 1, comprising:

a paper feed unit, a printing unit and a paper output unit; wherein:

said sheet transfer cylinder constitutes a pick-up cylinder that delivers sheets of paper from said paper feed unit to said printing unit, intermediate cylinders provided between each of a plurality of printers constituting said printing unit, impression cylinders provided within said printing unit and delivery cylinders that deliver said sheets of paper from said printing unit to said paper output unit, and said gripper opening/closing mechanism is provided in said sheet transfer cylinder.

4. A sheet-fed printing machine according to claim 3, wherein:

said printers, which are positioned above and below said impression cylinders, print on both sides of a sheet of paper being transferred through.

5. A sheet-fed printing machine according to claim 3, which is an offset printing machine.

6. A gripper opening/closing mechanism of a sheet transfer cylinder in a sheet-fed printing machine, comprising:

a plurality of grippers;

a gripper shaft whereupon said plurality of grippers are disposed over specific intervals; and a cam mechanism provided at two ends of said gripper shaft that causes said gripper shaft to move when said sheet transfer cylinder has rotated to a first specific position so that said grippers and an external circumferential side surface of said sheet transfer cylinder come in contact with each other and causes said gripper shaft to move in an opposite direction when said sheet transfer cylinder has rotated to a second specific position so that said grippers and said external circumferential side surface of said sheet transfer cylinder are separated from each other; wherein:

said cam mechanism comprises:

a lever mounted at each of two ends of said gripper shaft perpendicular thereto;

a first roller and a second roller respectively provided at outer ends of each said lever;

a first cam that is secured to a frame holding a rotating shaft of said sheet transfer cylinder and in contact with said first roller, which is provided with a greater circumferential surface with a first radius between said first specific position and said second specific position and a lesser circumferential surface with a second radius smaller than said first radius; and a second cam that is secured to said frame holding said rotating shaft of said sheet transfer cylinder and in contact with said second roller, which is provided with a lesser circumferential surface with a second radius at a position corresponding to said greater circumferential surface of said first cam and a greater circumferential surface with a first radius at a position corresponding to said lesser circumferential surface of said first cam.

7. A sheet-fed printing machine disclosed in claim 6, which is an offset printing machine; comprising:

a paper feed unit, a printing unit and a paper output unit; wherein:

said sheet transfer cylinder constitutes a pick-up cylinder that delivers sheets of paper from said paper feed unit to said printing unit, intermediate cylinders provided between each of a plurality of printers constituting said printing unit, impression cylinders provided within said printing unit and delivery cylinders that deliver said sheets of paper from said printing unit to said paper output unit, and said gripper opening/closing mechanism is provided in said sheet transfer cylinder.

8. A sheet-fed printing machine according to claim 7, wherein:

said printers, which are positioned above and below said impression cylinders, print on both sides of a sheet of paper being transferred through.

9. A gripper opening/closing mechanism for a sheet transfer cylinder in a sheet-fed printing machine, with said sheet-fed printing machine comprising a paper feed unit, a printing unit and a paper output unit; wherein:

said sheet transfer cylinder constitutes a pick-up cylinder that delivers sheets of paper from said paper feed unit to said printing unit, intermediate cylinders provided between each of a plurality of printers constituting said printing unit, impression cylinders provided within said printing unit and delivery cylinders that deliver said sheets of paper from said printing unit to said paper output unit, which is provided in each sheet transfer cylinder comprising:

a plurality of grippers;

a gripper shaft whereupon said plurality of grippers are disposed over specific intervals; and a cam mechanism provided at two ends of said gripper shaft that causes said gripper shaft to move when said sheet transfer cylinder has rotated to a first specific position so that said grippers and an external circumferential side surface of said sheet transfer cylinder come in contact with each other and causes said gripper shaft to move in an opposite direction when said sheet transfer cylinder has rotated to a second specific position so that said grippers and said external circumferential side surface of said sheet transfer cylinder are separated from each other; wherein:

said cam mechanism comprises:

a lever mounted at each of two ends of said gripper shaft perpendicular thereto;

a first roller and a second roller respectively provided at outer ends of each said lever;

a first cam that is secured to a frame holding a rotating shaft of said sheet transfer cylinder and in contact with said first roller, which is provided with a greater circumferential surface with a first radius between said first specific position and said second specific position and a lesser circumferential surface with a second radius smaller than said first radius; and a second cam that is secured to said frame holding said rotating shaft of said sheet transfer cylinder and in contact with said second roller, which is provided with a lesser circumferential surface with a second radius at a position corresponding to said greater circumferential surface of said first cam and a greater circumferential surface with a first radius at a position corresponding to said lesser circumferential surface of said first cam.

10. A sheet-fed printing machine according to claim 9, wherein:

said printing units, which are provided above and below said impression cylinders, perform double-side printing.

11. A sheet-fed printing machine according to claim 10 which is an offset printing machine.

* * * * *